US006273421B1

(12) United States Patent
Thalheimer et al.

(10) Patent No.: US 6,273,421 B1
(45) Date of Patent: Aug. 14, 2001

(54) ANNUNCIATING PREDICTOR ENTERTAINMENT DEVICE

(75) Inventors: Richard J. Thalheimer, San Francisco; Charles E. Taylor, Sebastopol; Shek Fai Lau, Foster City; Edward C. McKinney, San Rafael, all of CA (US)

(73) Assignee: Sharper Image Corporation, San Francisco, CA (US)

( * ) Notice: Subject to any disclaimer, the term of this patent is extended or adjusted under 35 U.S.C. 154(b) by 0 days.

(21) Appl. No.: 09/395,077

(22) Filed: Sep. 13, 1999

(51) Int. Cl.[7] ..... A63F 9/18
(52) U.S. Cl. ..... 273/161; 446/397
(58) Field of Search ..... 273/161, 138.1, 273/429; 446/397, 297, 404

(56) References Cited

U.S. PATENT DOCUMENTS

| | | | | |
|---|---|---|---|---|
| 3,119,621 | * | 1/1964 | Bookman | 273/161 X |
| 3,168,315 | * | 2/1965 | Bookman | 273/161 X |
| 3,675,241 | | 7/1972 | Glaser . | |
| 3,740,039 | * | 6/1973 | Prola | 273/161 |
| 3,798,833 | * | 3/1974 | Campbell | 273/161 X |
| 4,054,286 | * | 10/1977 | Dressler, Sr. | 273/161 |
| 4,072,314 | * | 2/1978 | Rosen et al. | 273/161 |
| 4,765,623 | * | 8/1988 | Cardillo et al. | 273/161 |
| 5,314,336 | | 5/1994 | Diamond et al. . | |
| 5,375,839 | | 12/1994 | Pagani . | |
| 5,476,407 | | 12/1995 | Hall, Jr. . | |
| 5,479,529 | * | 12/1995 | Nakagawa et al. | 273/161 X |
| 5,482,277 | | 1/1996 | Young . | |
| 5,775,695 | | 7/1998 | Byers . | |
| 5,971,826 | | 10/1999 | Lee et al. . | |
| 5,971,827 | | 10/1999 | Lee et al. . | |

* cited by examiner

*Primary Examiner*—Raleigh W. Chiu
(74) *Attorney, Agent, or Firm*—Fliesler Dubb Meyer & Lovejoy LLP

(57) ABSTRACT

A self-contained fortune telling entertainment device includes an electronic library of human speech and sound effects, to be selected and enunciated in apparent response to a user's question. User intent to use the device is detected, whereupon a pre-answer initiation mode is entered during which sound effects and/or speech is selected from the library and enunciated. After this period ends, a circuit then selects at least one sound, e.g., sound effect and/or vocalized speech, from the library for enunciation as the answer to a user's question, propounded before or during the pre-answer period. Selection of an answer or response may be random, quasi-random, or other, and may be influenced by detected ambient or environment conditions, and may be influenced by at least one user control. LEDs may be activated while the device is in use to provide visual as well as audible entertainment. The device may be handholdable in size, and can function without reliance upon ambient light.

33 Claims, 3 Drawing Sheets

ANNUNCIATING PREDICTOR ENTERTAINMENT DEVICE

FIELD OF THE INVENTION

The present invention relates generally to entertainment devices including hand-holdable entertainment devices, and more particularly to such devices that purport to predict the future and answer user's questions.

BACKGROUND OF THE INVENTION

Humans have long sought to learn what the future may hold for them. Over the millennia methods and devices for predicting the future have ranged from shaman reading the entrails of animals, to astrologers, and phrenologists. In more modern time, fortune telling has assumed a role that is more entertaining than serious.

A very popular fortune telling entertainment device is the so-called "Magic Eight Ball" product. This device typically is sized and shaped to look like a pool eightball. The device is hollow, filled with a liquid and has a transparent window at the bottom or base of the device. Within the device is a multi-surfaced float with different "answers" printed on the different surfaces. The number of answers is limited by the number of surfaces on the float, and is typically less than perhaps a dozen or so.

In practice, a user might ask the device a question, for example, will this application result in a patent. The user then shakes and inverts the device. Eventually the float rises and presses a surface (with an answer) against the window, which is now facing upward. The "answer" might be "yes", or "not obvious", or some other saying.

Since the device preferably is hand-holdable, the sphere portion of the ball is typically a few inches (perhaps 5–6 cm) in diameter. This dimension more or less dictates a maximum size for the float, and thus a maximum number of float surfaces. While creating more surfaces or facets on the float can allow for more answers, the size of the font with which the answers are printed or stamped into the float surfaces decreases. This in turn makes it harder to read smaller and smaller answers from a device that tries to provide a greater number of answers. Often the type with which the answer is printed is font size 10 or so. Further, such devices can be difficult to read under the best of circumstances, especially by elderly people or others with diminished eye sight.

The different "answers" of course appear more or less randomly, which promotes enjoyment, especially when the "answer" is incongruous to the question. However, for spectators observing an individual using the device, their enjoyment will be somewhat delayed because only one person at a time can read the answer. Often the person holding the device will see the answer and, if it is not too embarrassing, will then read it aloud, whereupon the spectators can join in the fun.

However due to the relatively small number of answers, the entertainment value of such devices can soon wear off. Unfortunately typically there is no way to open the device and change floats to change the collection of potential answers. The device is sealed at the time of manufacture. Another deficiency is that small children may be precluded from enjoying the device unless their hands are big enough to hold the device, and unless they can read. Further, the relatively heavy device is fragile and can break, if dropped, with resultant leakage of fluid over the floor or carpet area. Finally, the device provides only one the of entertainment stimulation, namely visual for the user close enough to the window to read an answer.

There have been attempts in the art to modernize entertainment devices that purport to predict the future. U.S. Pat. No. 4,765,623 to Cardillo (1988) describes a crystal ball toy comprising a light-permeable sphere, apparently a clear plastic ball, mounted on a base. The device appears to have required reasonably strong ambient light to operate. A light sensor within the device sensed when ambient light was interrupted by a user's hand casting a shadow on the light-permeable sphere. Such a double-interruption of ambient light randomly caused annunciation of one of some twenty-eight stored voice responses. Applicants believe the Cardillo device was sold commercially as part of a board or card game. The device was not especially robust, appears to have required ambient light for operation, and seems not to have met with great commercial success.

U.S. Pat. No. 5,482,277 to Young (1996) used a form factor similar to Cardillo's, e.g., a somewhat fragile appearing sphere mounted to a base. Cardillo disposed two electrical contacts on the surface of the sphere, which when touched by a user's hand would complete an electrical circuit, causing the sphere to emit light and a simulated voice message. Whether Young's device would operate reliably when the two electrical contacts eventually tarnished is not known.

In short, there is a need for a robust entertainment fortune telling device that can provide longer entertainment value than prior art devices. Preferably such device should provide a relatively large number of responses, perhaps a hundred or more, and should annunciate such responses audibly, so that all may instantaneously share in the response. To further augment the entertainment value, such device should emit unusual and entertaining sounds in an initiation period before the answer is annunciated, and preferably also provide visual entertainment. Such device should optimally provide an ability to alter the library of answers, including the ability to permit a user to record his or her own answers. The device should optionally allow answers to be annunciated in the user's voice or a humorous variation thereof. Finally, such device should be relatively lightweight and inexpensive to produce, should not require ambient light to function, and should be useable even by children and elderly persons without undue fear of breakage.

The present invention provides such a device.

SUMMARY OF THE INVENTION

The invention is a fortune telling device that in apparent response to a question, audibly annunciates an answer and/or sound effect selected from a variety of answers and sound effects. The device preferably is hand-holdable and includes a spherical shaped housing having a flattened bottom portion, a rather robust configuration. Alternatively, the device may be figure-shaped to look like a genie, or other character, or may be configured as a mirror or picture, handholdable or suitable for hanging on a wall. Preferably housed within the device are at least one mechanism that senses user intent to use the device, electronic circuitry, a battery, a sound transducer such as a speaker, and light sources such as LEDs.

Even before a user "asks" the device a question by touching the device or speaking aloud, a sense mechanism detects user intent, and starts a pre-answer initiating activity that can produce pre-answer sounds, annunciated words, and a light display. The user's intent to use the device may be sensed with a mechanism that may include any or all of a motion switch that detects user shaking or movement of the device, a strain unit that detects user contact (rubbing, perhaps) with the device, a proximity detector that detects closeness of a user, and a sound detector that detects a user's approach or words.

The output from the sense mechanism(s) actives electronic circuitry that optionally selects and annunciates (or plays) at least one of a repertoire of stored several pre-answer or initiation-period sounds. These sounds may include recorded speech, e.g., "uh, oh", "what now?", and the like, and/or may include sound effects including motion sounds such as "liquid swishing", "churning broken glass", "whirling" sounds, "cow bells", "oog-gaa" car horn sounds, etc. that can accompany physical movement of the device as detected by the sense mechanism. Such motion sounds preferably can change in intensity and/or pitch and/or message in proportion to strength and duration of detected device motion.

Pre-answer annunciated speech may include selections such as "hurry up, you are making me dizzy", and can include selections influenced by detected user intent activity. Thus, a device shaken overly vigorously or long might evoke a response such as "Enough already; ask your question!". The pre-answer period may be accompanied by a visual display from light sources within or on the device housing, preferably LEDs. An optional eccentrically mounted weight is mounted to rotate within the housing as the device is moved, to further promote the sensation of on-going activity within the device. A device housed in a genie-like figure or in a mirror configuration might provide a pre-answer initiation period sound inquiring "what would you like to know, master?" or "what beauty approaches me now?".

In the preferred embodiment, the pre-answer initiation period requires a predetermined number of detected user intent actions within a predetermined period, e.g., three shakings of the device within say four seconds, after which a selected answer or response (perhaps a sound effect) is annunciated. In other embodiments, a user can address the device with specific recognizable sounds or words to initiate the pre-answer period, e.g., for a device that is not hand-holdable.

Within the device electronic circuitry, which may be implemented with a microcontroller, includes a selector circuit and a library of answers and responses, among other circuits. The selector circuit preferably makes at least a pseudo-random selection from the library of an answer or response to be annunciated. If the library of answers is sufficiently large, it can suffice for the circuit to simply select and provide answers sequentially, or periodically sequentially.

In another embodiment, the selector circuit carries out a randomizer section, by outputting a random number that points to one or more storage locations within the memory, at which sound effects and/or human speech are stored. The library preferably stores over a hundred answers, some of which may be pre-answer words and sound effects, and some or all of the stored answers may be user-provided answers. The answer, sound effect(s) and/or stored human speech, is then annunciated by other circuitry and heard through the transducer by the user and by spectators in the general area. If a true randomizer circuit is used, the circuit may be programmed to reject an answer that has been recently selected, to avoid annunciating the same response or answer too frequently, thus boring the user.

Randomness of the selector circuit may be intentionally altered by the nature of the detected initiation activity, e.g., hard shaking might be interpreted as preceding a serious question or as indicating the present user is a male. The answer could then be selected from a portion of the library known to hold responses suitable for such assumptions.

Annunciated answers need not be limited to merely "yes" and "no" but can include a wide repertoire of sayings, often recorded in a humorous or sarcastic voice, for example "Oh sure" or "Give me a break" and/or sound effects. If desired, the voices of movie or TV personalities may be used to create the library of responses. Some of the responses may include or be solely non-verbal sound effects, e.g., a "choking" sound, a "hysterical laughter" sound, a "crying" or "sobbing" sound. More than one answer may be annunciated responsive to a single question, producing a Greek-chorus like response, or several answers can be annunciated one immediately after the other to provide a longer response. Optionally the selector circuit can provide a linkage between subsequent answers, for example following up a previous response of "No", with a response to a subsequent question of "No, again".

If desired, a "cheat" switch can be activated by a user to select a randomly selected or at least a pseudo-randomly selected response or answer that may be customized, for example, between a first characteristic and a second characteristic, e.g., a male rather than a female user, or vice versa. The device may include at least one environment sensor to detect and input data to influence answer selection to make the device appear more intelligent. For example, providing the device with an ambient light light sensor can cause the device to provide an answer such as "it is too dark in here for me to see you" if in fact the ambient light is dim, or "it is too bright in here" if the ambient light is bright. A humidity and/or temperature sensor may be used to augment an answer with "it seems like rain" (if appropriate) or "that question is as hot as today's weather" (if appropriate). Indeed a transducer sensor may be used with software to guess the sex or age of the user from voice characteristics and to help select a suitable answer for that gender or age.

Optionally the electronics may provide a solid state recorder permitting the user to pre-record some or all of the answers, which answers will be played back (when randomly selected) in his or her own voice. Optionally the internal circuitry can record the user's voice when posing a question and then synthesize the selected response using the user's voice or a comically altered version of the user's voice.

In all, the devices provides a combination of audible and visual entertainment that is shared simultaneously by user and audience alike. Unlike prior art devices, the invention may be thus enjoyed even in the absence of strong ambient light. After a response or answer has completed, the device turns itself off, to await a next detected user intent action.

Other features and advantages of the invention will appear from the following description in which the preferred embodiments have been set forth in detail, in conjunction with the accompanying drawings.

DETAILED DESCRIPTION OF THE PREFERRED EMBODIMENT

Figure 1C:
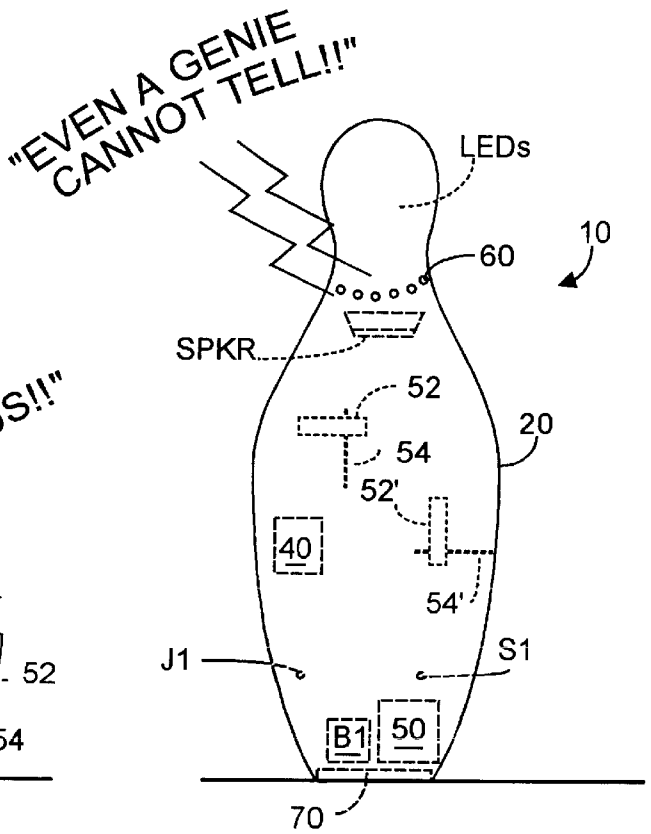
FIG. 1C is a perspective view of a figure or figurine-like embodiment of the present invention.
Figure 1B:
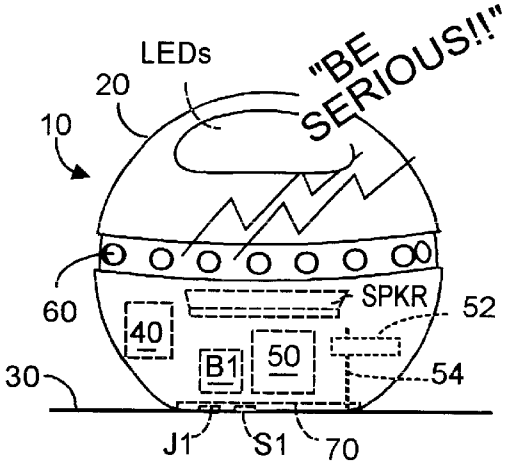
FIGS. 1A and 1B are perspective views of a hand-holdable sphere-like embodiment of the present invention.
Figure 1A:
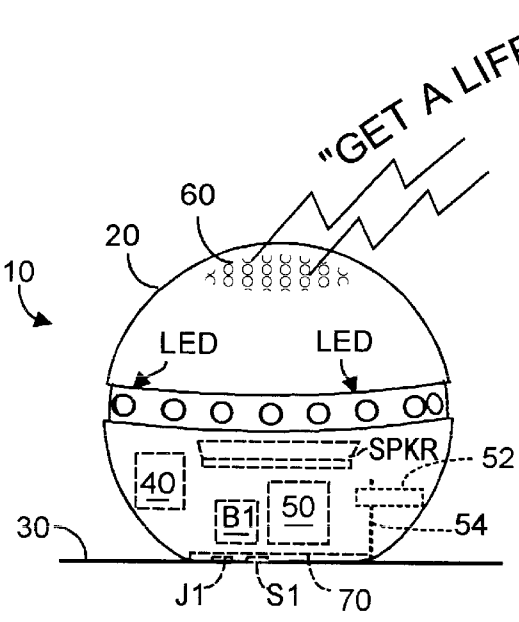

FIGS. 1A and 1B depict preferred embodiments of the present invention 10 as including a generally spherical housing 20 whose bottom region is preferably sufficiently flat to sit stably atop a surface 30, for example a table. Housing 20 preferably is made from a light weight plastic such as ABS material. For the embodiments of FIGS. 1A and lB, a typical housing diameter may be perhaps 6 cm to 11 cm, although other materials, housing shapes, and dimensions could be used. This configuration is sufficiently robust to permit the device to fall to the floor from a height of a meter or so without damage. Indeed, the robustness of the device permits its use in a "hot potato" or "musical chairs" type game in which the device is tossed from person to person until the device utters an answer. The person holding the device when the answer is annunciated is a loser (or perhaps a winner, depending upon game rules) and leaves the group, which continues to toss the device until ultimately a single person is left.

FIG. 1C depicts an alternative embodiment in which device 10 is figure shaped with a height that may vary from perhaps 10 cm to a meter or more, or indeed be human sized. Housing 20 may have a recognizable shape, a genie from a storybook or cartoon, a famous statue, etc. A genie-shaped device, such as indicated generally in FIG. 1C, might preface answers with a user-intent period sound selection such as "what is your command, master".

Figure 1D:
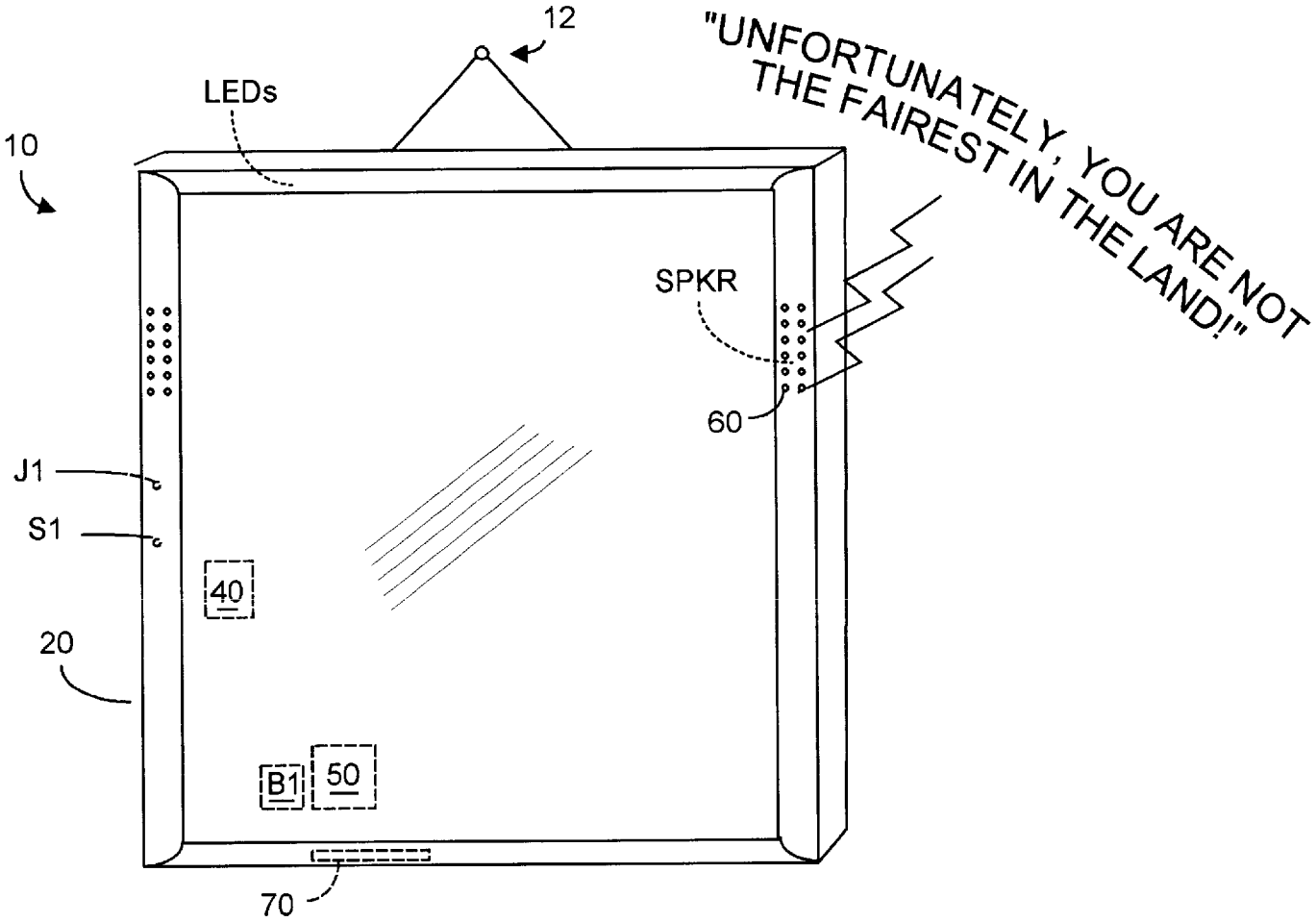
FIG. 1D is a perspective view of a mirror-like embodiment of the present invention.

FIG. 1D depicts a planar embodiment implementation in which the invention is housed behind a mirror or framed picture that may be handheld, or wall mounted with apparatus 12. User intent or pre-answer initiation for a wall hung device may be sensed with sound or infrared rather than with direct touching.

In the various housing, a region of housing 20 may include an access hatch or door 70 to provide user-access to battery B1 disposed within housing 20. In a preferred spherical embodiment, the device can be unscrewed into two halves to access B1. In the preferred embodiment, B1 comprise four series-connected AA batteries, although other battery types may instead be used. Alternatively, a wall adaptor AC:DC converter may used with DC operating potential being coupled to device 10 through a suitable input jack. Hatch 70 may also provide access to user controls that need not be frequently adjusted, for example a volume control, a sensor sensitivity control, a microphone control, etc. Of course housing configurations beside what is shown in FIGS. 1A–1D may instead be used.

The various embodiments include at least one sense mechanism 40, an electronic circuit 50 that may in fact be implemented with a microcontroller (perhaps an 8-bit digital voice microcontroller with 1 MB ROM with off-chip RAM), at least one transducer such as a speaker (SPKR), a microphone (MIC), a light source such as one or more light emitters, preferably light emitting diodes (LEDs), and an optional environment sensor 62. As described later herein, circuit 50 preferably includes at least a selector circuit and a library of responses and answers. A battery unit B1 preferably is disposed within housing 20 to power circuit 50 and the associated components. Housing 20 preferably also includes at least one user-operable control, e.g. S1, and at least one jack, e.g. J1.

Without limitation, sensing mechanisms 40 may include any or all of a motion sensing switch 40-2, a strain detector 40-4, a proximity detector 40-6 (e.g., infrared red including PIR and/or motion sensing), and an ambient sound detector 40-8. The function of these pre-answer initiation period sensing mechanisms is to detect a user's intent to use the device, typically manifest by the user's holding or shaking the device, or approaching the device, or making noise or other sounds in the vicinity of the device.

Without limitation, environment sensor 62 may include any or all of a humidity, temperature, light/darkness, and voice detector-recognition sensors. A humidity and/or temperature sensor, for example, can be used to sense air pressure, humidity, temperature in the environment surrounding device 10, and to permit selection of a response that mentions such detected environment. Thus, if sensor 62 detects that the environment is hot and dry, a response to a question might include the words "it is too hot and dry to answer you accurately, but the answer is . . . " where ". . . " is a response (a vocalized answer or a sound effect) selected from the library. Sensor 62 may also (or instead) sense ambient light, to select answers or responses appropriate to day or evening, e.g., "it is too early in the day to tell for sure, but . . . " where ". . . " is a separately selected response or answer. Sensor 62 may include voice recognition software executed by circuit 50 that can detect the age (young versus old) and perhaps sex (male versus female) of the user. Based upon such voice recognition, an answer or response appropriate to such a user can be selected from among the library of stored answers and responses.

A passive movement enhancing mechanism such as a weight 52 that is mounted eccentrically, off-center, upon a spin axis 54 may be included. Thus, when device 10 is lifted and moved, weight 52 will contribute to the sensation of activity within the device. If desired weight 52 may be associated with a spring mechanism that winds or unwinds relative to axis 52 to further enhance such sensation of internal activity, and more than one weight-axis combination may be provided, preferably with different spin axes.

When the invention is activated, which is to say when user intent to use the device is detected by a sensor 40 and/or 62, preferably light emitting diodes ("LEDs") will be visible on or within the wall of housing 10, in addition to the selection and generation of a pre-answer sound effect and/or verbal utterance. A sound emitting transducer such as a speaker ("SPKR") is disposed within housing 20, which may therefore include a perforated or baffled region 60 to permit emitted sound to be heard by a user and spectators near the device. In FIG. 1A, device 10 is shown annunciating the answer "Get a life", ostensibly in response to a question posed by a user, although the answer could instead have been a recorded sound effect, e.g., a cow "moo-ing", an "oooga horn", a railroad train "chooga-chooga", a "whooshing", a "whirling" sound among many other stored or generatable sounds. Indeed, an answer may comprise annunciated words and one or more sound effects, preferably accompanied by a light display using LEDs or the like.

As will be described, one or more of the LEDs can also be activated, sequentially and/or simultaneously, to provide an entertaining light show, during detection of user-intent, and during the annunciated "answer" or response. Thus, it will be appreciated that device 10 can provide both audible and visual entertainment that can be enjoyed by more than one person simultaneously.

Figure 2:
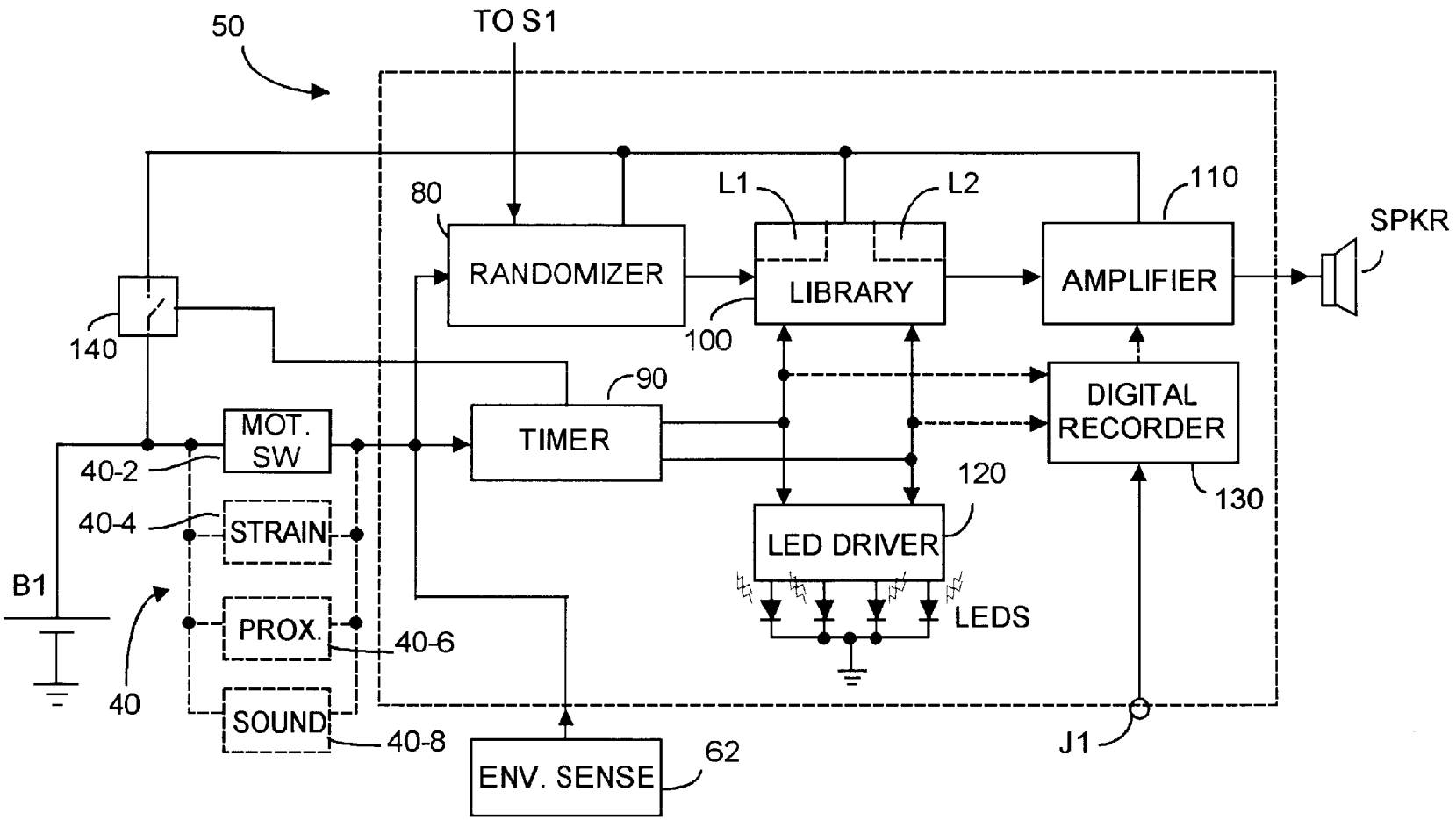
FIG. 2 is a block diagram of a preferred embodiment of the present invention.

FIG. 2 is a block diagram of circuitry 50. Circuit 50 preferably includes a selector unit 80, a timer circuit 90, an electronic library of recorded sounds 100, an audio amplifier 110, a LED driver 120 (if device 10 includes LEDs), and optionally a solid state recorder 130 that may be digital or analog. If desired a user-control may be provided to control the amplitude of the output from amplifier 110, and thus the volume of the speaker annunciated answers.

In practice, a user intending to use the device can approach device 10 and initiate the pre-answer period. As noted, detection of user intent and onset of the pre-answer initiation period can be accomplished using a variety of sensing methods ranging, without limitation, from PIR to voice detection and recognition, to strain detection, to detection of mechanical vibration.

Preferably circuit 50 defines the pre-answer user intent period as the duration of a given number of identifiable user activities, e.g., three separate vibrations or shakings of device 10, within a given time period, e.g., about four seconds, although other parameter values may be used. Typically during or immediately after this preanswer period, the user will annunciate a question to be "answered" by the device.

As noted, one or more mechanisms 40-2, 40-4, 40-6, 40-8 (or other sensor mechanism types) sense this user intent or pre-answer initiation period activity and cause activation of circuit 50. For example, in response to vibration or shaking, motion switch 40-2 closes at least intermittently, which provides at least a pulse of voltage from B1 to a timer circuit 90. The intermittent pulse also causes an electronic switch 140 (e.g., a MOS FET) to be closed by timer 90, which now receives operating potential independently of the state of the motion switch or other sensing mechanism. Of course other circuit configurations may instead be used.

A motion switch sense mechanism 40-2 may be implemented in many ways. For example, a multiple leaf type switch may be used where motion vibrates at least one leaf into electrical contact with an adjacent switch pole. If desired, a conductive pendulum may be suspended through a conductive eyelet or loop such that in a rest position the pendulum does not contact the loop. However if the device is moved, such vibration will cause the pendulum to swing slightly, making electrical contact with the surrounding loop. A motion switch may be constructed using dual concentric contacts, such that mild vibration may be distinguished from heavy shaking. The outputs from such a motion switch may advantageously be used to command "mild motion" type pre-answer sounds as contrasted with "heavy motion" type pre-answer sounds. "Heavy motion" might include annunciated sound effects such as horses "clopping", loud "whirring" noises and the like. Indeed, heavy motion sounds might included annunciated speech such as "enough already, I'm getting dizzy".

One or more strain gage sense mechanisms 40-4 may be mounted on or in the wall of housing 20. When a user contacts (touches, rubs, or holds, etc.) device 10, the resultant physical contact will produce mechanical strain in housing 20, which strain is detected by strain gage(s) 40-4. Stress gages 40-4 then perform the functions described above for motion detector 40-2.

If desired, initiation can be sensed with a proximity switch 40-6 that may be implemented using capacitive coupling, IR detection, PIR, RF doppler, among other techniques. As a user approaches device 10, proximity switch 40-6 detects the approach and performs the functions above-noted for the motion switch.

It may also be useful to provide a sound sense mechanism 40-8 that can perform the role of motion switch 40-2 but in response to ambient sound. Ambient sound could include footsteps or speech made while approaching the device, and indeed could include speech recognition sensing such that the voice of a given user (perhaps the owner of the device) might be recognized by voice patterns using electronics within device 10. A sound detecting sense mechanism is especially useful if device 10 is too large or too heavy to be handheld, for example a large figurine such as shown in FIG. 1C, or a wall hanging device such as shown in FIG. 1D. A device housed within say a book on a bookshelf might also include sound detection.

A combination of proximity and motion detection permits enhancing the sound effect(s) emitted during the pre-answer initiation period. For example, when proximity is detected, device 10 could be caused to annunciate one or more sound effects such as "whooshing", "oh, oh!", a "cow bell", "knocking", "oogah horn", "rattle", "sandpaper". If desired, motion-specific sounds could be provided during user-vibration of the device, as detected by an appropriate sense mechanism. In the preferred embodiment, the various user intention sensors do not rely upon the presence of strong ambient light, in contrast to some prior art devices. Thus while a preferred embodiment may provide an environment sensor 62 that includes an ambient light sensor, such light sensing preferably is used to augment selection of an appropriate and entertaining answer rather than to signal user intent to use the device.

In the above example, responding to motion and/or strain and/or proximity detection, electronic switch 140 will latch closed until such time as it is permitted to open in response to a signal denoting the end of an annunciated answer or response and any accompanying light display.

As shown further in FIG. 2, initial pulse(s) from the motion (or other) switch may be coupled to a selector circuit 80 that is used to select an answer or response from library 100. If selector 80 functions as a randomizer, its output will be a digital value that is randomly selected. In the preferred embodiment, randomizer circuit 80 includes a pseudo-random number generator that has a different seeding with each activation. Preferably a record of recent history of answer selections made by circuit 80 is maintained to reject for annunciation a selected answer that was very recently selected. The recent history can include several past selections to reduce the likelihood of users or spectators becoming bored with the device due to repetitive answers. If a proposed selected answer is found in the recent history record, another answer is selected instead and annunciated.

In the preferred embodiment, the randomizer output is used as a pointer to a location or locations within memory 100, from which location a stored answer or response is selected for annunciation. The dynamic range of the digital output is scaled such that a quantized random value will define one of a plurality of storage addresses in a library 100. Other randomizing function implementations may be used, however.

Library 100 holds preferably one hundred or more different sound effects and vocalized speech answers. If desired, library 100 may be thought of as including library contents L1 and L2, where for example L1 represents a library of a dozen or more sound effects selectable during the device pre-answer initiation stage and possibly during answer period as well. In the preferred embodiment, library 100 is a microcontroller embedded with memory that may be internal or external, for example, a removable flash memory card. Other implementations are of course possible, including implementing substantially all of circuit 50 as a microcontroller.

Understandably if library 100 hold a hundred or so answers or responses, selector circuit 80 need not be a true randomizer. Indeed, if memory 100 is sufficiently large, e.g., more than a few dozen answers, circuit 80 could simply step sequentially through the various responses stored in the memory. Thus on one round of device use circuit 80 might select response number 1 from memory, on the next round of use response number 2 might be selected, on the next round of use response number 3, etc. Alternatively, circuit 80 might perform a quasi-random selection function by periodically sequencing through the library, e.g., selecting stored response number 1 on round one of device use, response number 3 on the next round of use, then response number 5, and until reaching the end of the library, whereupon response number 2 then response number 4 then response number 6, etc. would be selected in turn, and so forth. The term quasi-random shall be understood to include such sequential and periodic sequential selection. A function of selector 80 is to avoid selecting the same answer or response too frequently to the exclusion of other answers and responses, so that the user will not become bored with the device.

As suggested by FIG. 2, the randomness or quasi-randomness of an answer or response to be selected by circuit 80 may be altered by the physical nature of the detected user intent. Thus, a relatively violent shaking of device 10 might be used to electronically steer circuit 80 towards selecting more "masculine" responses from the library. Those skilled in the relevant art will recognize that different categories may be assigned to different sound effects and speech stored in library 100, which categories may be used in such steered selection.

During the initiation period during which a user shakes device 10 or otherwise signals user intent, a selected sound (be it a sound effect or vocalized speech) from L1 in library 100 will be amplified by an amplifier 110 and annunciated through a transducer such as a loudspeaker ("SPKR"). As noted, the sound effects may include a "whooshing" sound, or a "whirling water" sound, or a "breaking glass" sound. If desired, the motion switch could be augmented by a strain type transducer such that excessive shaking motion could dictate one of a select few stored library sounds would be played, regardless of the randomizer output. Such few sounds might include "ouch!", "stop it, you're killing me!", an explosion, or other entertaining sounds indicating excessive force.

Timer 90 or other circuitry can permit the shaking-type sound to be played via the speaker for a second or two (or longer if the shaking continues longer). If desired, the shaking-type sound could be followed by a suspense type sound, e.g., a "whirling sound" evocative of a spinning roulette wheel, etc., after which the selected "answer" is annunciated. The answer, the phrase "get a life" in FIG. 1A, or "be serious" in FIG. 1B, or "even a genie cannot tell" in FIG. 1C, or "unfortunately, you are not the fairest in the land" is then amplified and played through the speaker.

Preferably shaking and motion-type sounds played during the pre-answer initiation period are synchronized with any detected vibration. Thus rapid shaking might produce rapid choruses of broken glass sounds, and so forth. Preferably circuit 50 recognizes a certain number of user-initiated events, e.g., vibrations occurring within a certain time period, after which a selected answer or response is annunciated, preferably accompanied by a light display from LEDs. In the preferred embodiment, end of the user-intent period can be defined as detection of a third shaking or other user-caused event occurring within given time period, e.g., perhaps four seconds.

In contrast to prior art Magic Eight Ball type devices, the "answer" is heard and thus is immediately known to all persons within earshot, not just to the user. This enhances the entertainment value, especially where a user dissatisfied with a Magic Eight Ball visual answer might not announce the answer and simply re-shake the Magic Eight Ball.

To further augment the entertainment value, circuitry 50 preferably includes a LED driver 120 whose output activates one or more LEDs. As noted, the LED activation can be sequential, parallel, or a combination of each, and can comprise analog and/or digital drive including duty cycle drive variation. In the preferred embodiment blue, red, and yellow LEDs may be activated so as to produce an interesting change or burst of colors, varying color patterns including pure colors. These display variations may be coupled to responses, answers, and/or detected user intent activity, to augment aural entertainment with visual entertainment. For example, shaking the device can instantly cause changes in LED color and/or intensity proportional to magnitude and/or duration of the shaking or other detected use intent action. Circuit details for activating LEDs in sequence or otherwise are well known to those skilled in the relevant art and are not given here.

If desired, certain answers in the L2 portion of library 100 could be categorized according to characteristics, e.g., "happy answers", "sad answers", "neutral answers". If the randomizer selects, for example, a "happy answer", circuitry 50 could recognize this fact by the circuit 80 selected answer address and could command activation of an appropriate LED or LED pattern. For example, if multicolored LEDs are used, perhaps green and red LEDs would be activated for a happy answer, perhaps blue LEDs for a sad answer. As noted, not all of the answers need be audible speech, and some answers may be sound effects.

An LED display could occur from the start of the user-intent period through the end of the answer annunciation, or some shorter period of time. After the answer has been annunciated, the audio and visual display are terminated, and circuit 50 is decoupled from B1. B1 will remain decoupled from circuit 50 until the next initiation of a user-activity, thus extending the life of battery B1.

In a preferred embodiment, one or more of the answers stored in L2 in library 100 may be recorded by entertainment celebrities, whose voices will be instantly recognized by most listeners. Funny answers might be recorded by comedians, tragic answers by tragedians, and so forth.

Although the answers are preferably totally randomly selected by randomizer 80, if desired a "cheat" function could be implemented with a user-operable control S1 to at least determine which of at least two characteristics the randomly selected answer shall exhibit. For example, answers suitable to a male interrogator might be stored in a certain block of addresses within library 100, whereas answer suitable to a female interrogator might be stored in another block. A male user wanting "male" appropriate answers might push or otherwise activate switch S1, whereas a female user might not activate S1 (or vice versa). The randomizer would then be forced to randomly select an answer, but from the male appropriate block of addresses or from the female appropriate block of addressed.

Some answers might be termed "happy" answers, e.g., "fortune lies ahead", whereas others might be "sad" or "disappointing" answers, e.g., "get a life". Switch S1 or a second switch could be incorporated to command at least the mood of the answer, although the answer would still be randomly selected, albeit from the S1 (or other switch) selected mood of answers.

If desired, a specific answer might be given more than one address within memory 100, to permit a variable weighting and to save memory space. Thus, "fortune lies ahead" might be indexable both as a "happy" answer and as a "serious" answer. With a preferably random frequency of occurrence, multiple answers might be given simultaneously, in a Greek chorus fashion, or given serially, e.g., "Yes . . . the answer is certainly true", where "yes" and "the answer is certainly true" are two separately stored phrases that need not be given together.

On preferably random occasion, one answer might be logically linked to a preceding answer, to add to the amusement value of the device, in anticipation that a subsequent question is related to a previous answer. Such linkage alters the randomness decision of unit 80, but can produce entertaining results. For example if a previous response was "No", the subsequent response might be "I thought I just replied no". Implementing this function may be carried out by categorizing classes of stored answers, e.g., negative answers, positive answers, ambiguous answers. In the case of an ambiguous first answer such as "who ordered a pizza?", a next linked answer might be "did someone say pizza??" Category flags (e.g., yes, no, ambiguous) representing the last few responses may be stored (e.g., in memory associated with 100) and if a reinforcing type answer is now desired, selector 80 can select, randomly, quasi-randomly, or otherwise, from locations in library 100 whereat groups of such categorized responses are to be found.

As noted, randomness of unit 80 can also be intentionally altered by the sensed magnitude of the initiation activity associated with user intent. Thus, hard shaking might be interpreted as suggesting that a rather serious question is about to be propounded, or that the present user is a male. An answer or response may then be selected by circuit 80 from a portion of library 100 known to contain answers or responses suitable for such assumptions. Further, an answer or response may also be influenced by environmental factors as detected by sensor 62, described earlier herein.

Circuitry 50 may also include a solid state recorder 130 whose audio input may be provided via a jack J1 or perhaps via a dual function transducer SPKR. Alternatively, a separate audio input transducer such as an electret microphone could be included in the device housing for optimal voice detection. Recorder 130, which could be digital or analog, can permit a user to record his or her own voice or perhaps voices of friends reading answers into a portion of library 100 or into a user writable library also within circuitry 50. A device 10 intended for use by children might have answers appropriate for children recorded by parents or older siblings.

At least a portion of library 100 may be implemented as removable memory. This feature permits providing different libraries of answers and responses simply by removing one memory unit and replacing with another. One such memory unit may store answers and responses appropriate for children, another for adults, perhaps a third would have answers in a foreign language being studied by a user, and so forth. Compact memory units are readily available in PCMCIA and other form factors with which to implement this feature.

Circuitry 50 can also use the just-recorded voice of the user, e.g., while posing a question, as a voice with which a selected answer may be annunciated. If desired, the user's voice may be altered to produce a humorous, often cartoon-type voice characteristic. Such altering is readily accomplished, for example, by varying the frequency of clock pulses to the associated voice synthesizer circuitry, e.g., which circuitry may be associated with unit 130 in FIG. 2.

Specific details for the various circuits referred to herein have not been provided as those skilled in the art will readily understand from FIG. 2 how the present invention may be implemented.

As was noted, prior art devices provided visual-only entertainment from a very limited selection of answers that can only be enjoyed by a single user, until the answer was read aloud or the device passed around so others with good enough eyesight could also read the answers. By contrast, the present invention provides both audible and visual entertainment, and the number of audible responses is limited solely by the storage contents of library (or libraries) 100. The number of storable responses may readily exceed one hundred using conventional off-the-shelf solid state library storage integrated circuits. The present invention is physically robust and its audible and visual entertainment may be shared simultaneously by user and audience alike, without reliance upon strong ambient light.

Modifications and variations may be made to the disclosed embodiments without departing from the subject and spirit of the invention as defined by the following claims. For example, annunciated sounds could be augmented by including transducers that emit their own sound, e.g., a siren module, a whistle module, etc.

What is claimed is:

1. An entertainment fortune telling device comprising:

a housing;

a mechanism, disposed in said housing, that detects user intent to use said device, said mechanism operable without dependence upon ambient light and without dependence upon impedance of a hand of said user;

circuitry, coupled to said mechanism and coupleable to a power source, including a library storing a plurality of annunciable sounds including at least a first sound and a second sound, and a selector, coupleable to said library, that selects at least one of said sounds for annunciation following onset of user intent as detected by said mechanism; and at least one transducer for annunciating a selected sound.

2. The device of claim 1, wherein said mechanism includes at least one of (a) a motion sensor, (b) a strain sensor, (c) a temperature sensor, (d) an infrared sensor, (e) a range sensor, and (f) a sound sensor.

3. The device of claim 1, wherein:

said circuitry is disposed within said housing;

said first sound includes a sound effect; and said second sound includes annunciable speech.

4. The device of claim 3, wherein said first sound includes at least one motion-type sound effect, and said second sound includes at least one humorous speech sound.

5. The device of claim 1, wherein said selector includes a selector circuit that selects one of said sounds in a manner selected from a group consisting of (a) a random selection, (b) a sequentially progressive selection, (c) a progressive selection of entries not immediately sequential to each other, and (d) a quasi-random selection.

6. The device of claim 1, further including:

a recent history memory storing a history of recently selected sounds;

wherein said circuitry rejects for annunciation a sound selected by said selector if said sound is present in said recent history memory.

7. The device of claim 1, further including at least one environment sensor coupled to said mechanism;

wherein an output of said environment sensor can affect selection by said selector.

8. The device of claim 1, wherein an output of said mechanism can affect selection by said selector.

9. The device of claim 1, wherein said circuitry includes a microcontroller.

10. The device of claim 1, wherein:

said circuitry defines and recognizes end of a user intent period; and following end of said user intent period said circuitry enables said selector to select from said library for annunciation a response to a question propounded by said user.

11. The device of claim 10, wherein said response includes at least one of (a) vocalized speech, and (b) a sound effect.

12. The device of claim 10, wherein:

said response includes at least a first word stored in a first location in said library, and at least a second word stored in a second location in a library;

wherein said first word and said second word are annunciated in a manner selected from a group consisting of (a) sequentially, and (b) at least partially overlapping as to produce a Greek chorus effect.

13. The device of claim 12, wherein at least said first word and said second word are logically linked by said circuitry.

14. The device of claim 10, wherein:

said device further includes at least one of (a) an environment sensor coupled to said mechanism wherein selection of said response is affected by an output from said environment sensor, and (b) a user operable switch forcing selection of said response from a narrowed group of responses stored in said library.

15. The device of claim 1, further including:

means for storing a user's voice and for annunciating at least a portion of a selected sound with a voice selected from a group consisting of (a) said user's voice, (b) a frequency altered version of said user's voice, (c) another person's voice, and (d) a frequency altered version of said another person's voice.

16. The device of claim 1, further including:

an off-center weight disposed within said housing for rotation about an axis in response to user movement of said device.

17. The device of claim 1, further including:

at least one light emitting device; and means for activating each said light emitting device during at least a portion of use of said device.

18. The device of claim 17, wherein:

said means for activating activates at least one light emitting device in a manner related to annunciation of a selected sound.

19. The device of claim 1, further including:

means for inputting into at least a portion of said library user-input for annunciation by said transducer.

20. The device of claim 1, wherein said housing has a shape selected from a group consisting of (a) a sphere with a flattened bottom portion, (b) a figure, (c) a genie, (d) a planar shape, (e) a picture, and (f) a mirror.

21. A self-contained entertainment fortune telling device comprising:

a handholdable housing;

means for detecting user intent to use said device, disposed in said housing and operable without requiring ambient light;

a circuit, coupled to said means for detecting and coupleable to a power source, said circuit defining a user intent period initiated by said means for detecting, and defining a response period commencing with conclusion of said user intent period, said circuit including:

a library storing a plurality of responses including at least one annunciable sound effect, and at least one annunciable speech;

means for selecting at least one of said responses in said library;

a transducer that enunciates responses selected by said means for selecting; and at least one LED coupled to said circuit for activation during at least one of said user intent period and said response period;

wherein during said user intent period said means for selecting selects one of said responses for annunciation by said transducer; and during said response period said means for selecting selects a different one of said responses for annunciation by said transducer.

22. The device of claim 21, wherein said means for detecting user intent includes at least one of (a) a motion sensor, (b) a strain sensor, (c) a temperature sensor, (d) an infrared sensor, (e) a range sensor, and (f) a sound sensor.

23. The device of claim 21, wherein said means for selecting selects one of said responses in a manner selected from a group consisting of (a) a random selection, (b) a sequentially progressive selection, (c) a progressive of entries not immediately sequential to each other, and (d) a quasi-random selection.

24. The device of claim 21, wherein said means for selecting has at least one characteristic selected from a group consisting of:

(a) said means for selecting rejects for annunciation a response that was recently selected, (b) selection by said means for selecting is affected by an output of said means for selecting.

25. The device of claim 21, wherein:

said device further includes at least one of (a) an environment sensor coupled to said mechanism wherein selection of said response is affected by an output from said environment sensor, and (b) a user controllable mechanism forcing selection of said response from a narrowed group of responses stored in said library.

26. The device of claim 21, wherein a selected said response includes at least a first word stored in a first location in said library, and at least a second word stored in a second location in a library;

wherein said first word and said second word are annunciated in a manner selected from a group consisting of (a) sequentially, and (b) at least partially overlapping as to produce a Greek chorus effect.

27. The device of claim 26, wherein at least said first word and said second word are logically linked.

28. The device of claim 21, further including:

means for recording a user's voice; and means for enunciating a selected said response as speech using a voice selected from a group consisting of (a) a voice substantially that of said user, (b) a voice modified from a voice of said user, (c) another person's voice, and (d) a frequency altered version of said another person's voice.

29. The device of claim 21, further including:

an off-center weight disposed within said housing for rotation about an axis in response to user movement of said device.

30. The device of claim 21, further including means for activating at least one said LED responsive to a response annunciated by said transducer, activation altering at least one of (a) an apparent color of an LED, (b) duty cycle of an LED, (c) overall hue of each activated LED.

31. The device of claim 21, wherein a substantial portion of said housing has a generally spherical shape.

32. A method for entertaining a user with an electronic fortune telling device, the method comprising the following steps:

without using ambient light or using impedance of a user's hand, detecting user intent to use said device;

providing a library of possible responses to a user propounded question, said responses including at least one sound effect and one vocalizable speech;

selecting one of said responses from said library; and annunciating a selected one of said responses.

33. The method of claim 32, wherein a step of selecting is carried out at least quasi-randomly.

* * * * *